US005140922A

United States Patent [19]

Bowman et al.

[11] Patent Number: 5,140,922

[45] Date of Patent: Aug. 25, 1992

[54] LIFT FOR A WATERCRAFT

[75] Inventors: James W. Bowman, 9440 Harbor Point Dr., Bloomington, Ind. 47401; George T. Simpson, Mooresville; Paul A. Simpson, Indianapolis, both of Ind.

[73] Assignee: James W. Bowman, Mooresville, Ind.

[21] Appl. No.: 633,456

[22] Filed: Dec. 24, 1990

[51] Int. Cl.[5] ..... B63C 1/02

[52] U.S. Cl. ..... 114/45; 114/270; 405/4

[58] Field of Search ..... 114/44–49, 114/258–260, 270; 405/1.7; 440/39

[56] References Cited

U.S. PATENT DOCUMENTS

| | | | |
|---|---|---|---|
| 3,416,479 | 12/1968 | Strohmeier | 114/45 |
| 3,916,811 | 11/1975 | Fromnick et al. | 114/45 |
| 3,967,570 | 7/1976 | Bradfield | 114/45 |
| 4,954,011 | 9/1990 | Stenson | 405/3 |

OTHER PUBLICATIONS

Hydrohoist Boat Lifts Advertisement, Hydrohoist Boat Lifts, Claremore Okla., 74017, Date Unknown.

Bowman Simpson and Simpson, "Description of a Conventional Winch-Raisable Boat Lift" (p. 4 of the Instant Application).

*Primary Examiner*—Edwin L. Swinehart

*Attorney, Agent, or Firm*—Ice Miller Donadio & Ryan

[57] ABSTRACT

A lift is placeable in a waterbody for a watercraft having a water intake port and a water drawing device for drawing water through the water intake port. The lift includes a tank. The tank has an interior and an exterior, with the interior including a chamber. The tank also has an upper surface configured for receiving the watercraft, and a water inflow port and a selectively actuable valve for permitting water to flow into the chamber. A water outflow port is provided which is configured to be matable with the water intake port. The water intake port of the watercraft can be mated with the water outflow port of the tank to permit the water drawing device of the watercraft to draw water out of the tank.

22 Claims, 4 Drawing Sheets

LIFT FOR A WATERCRAFT

TECHNICAL FIELD OF THE INVENTION

The present invention relates to a lift for watercraft, and more particularly, to a floatable, submersible and raiseable lift especially adapted for use with personal watercraft.

BACKGROUND OF THE INVENTION

A recent phenomenon in the marine industry has been the increasing presence of personal watercraft such as the WAVERUNNER and SUPERJET brand watercraft manufactured by YAMAHA WATER VEHICLES, and the JETSKI TANDEM watercraft manufactured by KAWASAKI. These personal watercraft generally comprise small marine vehicles powered by inboard engines. Personal watercraft differ substantially from traditional small watercraft such as row boats, fishing boats and the like. In appearance, most personal watercraft resemble snowmobiles wherein the skis and tracks have been replaced by a hull and propulsion system.

One difficulty facing the designers of such personal watercraft (PWCs) is providing a means for isolating the propeller of the propulsion system from possible entanglement with the body parts of the person using the personal watercraft. The small size, and manner in which PWCs are used often results in riders falling off the PWCs. Additionally, the feet and hands of the user often dangle off of the PWC during use. The use of a traditional, exposed propeller in such situations would likely result in a large number of injuries to users.

To avoid such injuries, the makers of PWCs have generally adopted a propulsion system wherein the moving members of the propulsion system are inaccessible to body parts. Typically, such a system takes the form of a water tunnel formed in the underside of the hull of the PWC. The tunnel typically includes a water intake port comprising a grate disposed generally flush with the underside surface of the hull, an impeller system disposed in the tunnel for drawing water through the water intake port, and a water exhaust port disposed in the rear portion of the hull for propelling water out the rearward end of the PWC to cause it to move forward. The impeller is linked by a mechanical linkage to the engine of the PWC, which typically comprises a motorcycle engine, lawn mower engine or a variant thereof. The above described propulsion system has generally proven quite satisfactory for providing a means for both propelling the watercraft and avoiding injury to users caused by the entanglement of body parts in the system.

Those familiar with boating will appreciate that one of the inconveniences suffered by boaters (including PWC users) involves providing a suitable lift for the watercraft. A suitable lift for watercraft will generally provide three primary features. The first feature is that the lift should provide a secure anchorage for the watercraft, to prevent the watercraft from drifting away from the spot at which it is anchored under the influence of waves, tide and current. A second feature is that the lift should include means that provide ingress and egress to the watercraft. Because of the typical draft requirements possessed by watercraft, many watercraft cannot be placed directly adjacent to the shore. Rather, they must be moored at some distance from shore wherein the water is sufficiently deep to prevent the boat from being "grounded". Typically, some sort of walkway is necessary to enable the user of the boat to travel between the shore and the boat without requiring the user to wade through the water.

A third preferred feature of a lift is that the lift include a platform on which the boat is stored which permits the hull to be raised out of the water, and lowered into the water. When a boat is being stored, it is preferred that the hull be raised completely out of the water to prevent the hull of the boat from becoming fouled by algae, barnacles and the like. In order to use the boat, however, means must be provided to lower the boat into the water to a position wherein the boat can float free of the lift.

Several lifts exist that embody these three features. Probably the most popular type of lift that embodies these three features is a winch-raiseable lift available from several manufacturers. Such a winch-raiseable lift typically includes either four or six generally upright tubular posts that either rest on the bottom of the lake, or are driven into the bed of the lake. These upright posts are connected by a generally rectangular frame that is also made of tubular steel. At least two transverse members extend between the side members of the frame to provide a surface on which the boat can rest. A winch mechanism is provided for raising and lowering the transverse members to raise the watercraft out of, and lower the boat into the water. Typically, the winch mechanism is hand actuated, and comprises a large (e.g. 36" diameter) wheel that is coupled to a winch for drawing cable that extends between the winch and the transverse members.

Although such lifts do perform their intended function in a workmanlike manner, room for improvement exists. One area in which such lifts can be improved is in the convenience of operation of such lifts. The wheel cranking mechanisms are often difficult to use, require a considerable amount of maintenance, and require a considerable amount of effort and time to lift the watercraft completely out of the water.

It is therefore one object of the present invention to provide a lift for a watercraft that permits a watercraft to be raised out of the water for storage, and lowered into the water for launching, which is more convenient than the winch actuated lift described above.

SUMMARY OF THE INVENTION

In accordance with the present invention, a lift is provided that is placeable in a waterbody for a watercraft having a water intake port and a water drawing means for drawing water through the water intake port. The lift comprises a tank. The tank has an interior and an exterior, with the interior including a generally hollow chamber. The tank also has an upper surface configured for receiving the watercraft, and a water inflow port and a selectively actuable valve means for permitting water to flow into the chamber. A water outflow port is provided which is configured to be matable with the water intake port. The water intake port of the watercraft can be mated with the water outflow port of the tank to permit the water drawing means of the watercraft to draw water out of the chamber of the tank.

Preferably, the tank is generally mattress-shaped, and includes an upper surface that is configured to receive the hull of the watercraft thereon. Additionally, longitudinally extending floatation means can be provided that extend along the sides of the tank to provide additional floatation to the tank, and also provide walkways for permitting ingress and egress to a user of the lift.

One feature of the present invention is that the water drawing means of the watercraft can be mated to the water outflow port of a tank to raise and lower the lift. Preferably, the water drawing means comprises the impeller propulsion system of the watercraft itself.

This feature has the advantage of substantially enhancing the convenience of use of the lift. Rather than the user being forced to operate an electric winch, or hand-crank a winch for a lift, the user can raise the lift merely by driving the watercraft onto the lift, aligning the water intake port of the watercraft with the water outflow port of the lift, and allowing the engine and impeller of the personal watercraft to draw water out of the tank and thus raise the lift. As will be appreciated, this operation can be performed without the user ever being required to dismount the personal watercraft.

Another feature of this present invention is that the use of the engine of the watercraft to perform the work in raising and lowering the lift makes the lift especially adaptable for use in remote locations. For example, the use of the watercraft's own engine obviates the need to run any electrical cords to the lift.

It is also a feature of the present invention that the tank and floatation means are configured to possess sufficient buoyancy to allow the rear surface of the tank to be positioned slightly below the surface of the water when the chamber is filled, and to be above the surface of the water when the chamber is empty. This feature has the advantage of enabling the boat to be "dry-stored". By enabling the boat to be dry-stored, the user avoids the build-up of algae, mold, barnacles and other fouling materials on the hull of the watercraft.

A further feature of the present invention is that the floatation means are configured so that they extend along the sides of the tank, and include forward portions that extend forwardly of the tank. This feature has several advantages. One advantage is that the placement of floatation means along the side of the tank provides a means for laterally positioning the watercraft on the upper surface of the tank. A second advantage is that, when the chamber is full, the forwardly extending portions of the floatation means cause the rear surface of the tank to be at a level below the front surface of the tank, thus causing the upper surface of the tank to be inclined at an angle from horizontal. The advantage provided by this angled attitude of the upper surface is that it provides a ramp surface that facilitates placement of the watercraft on the upper surface of the tank, and launching of the watercraft from the upper surface of the tank.

Additional features and advantages of the present invention will become apparent to those skilled in the art upon consideration of the following detailed description of a preferred embodiment exemplifying the best mode of carrying out the invention as perceived presently.

BRIEF DESCRIPTION THE DRAWINGS

DETAILED DESCRIPTION OF THE DRAWINGS

Figure 1:
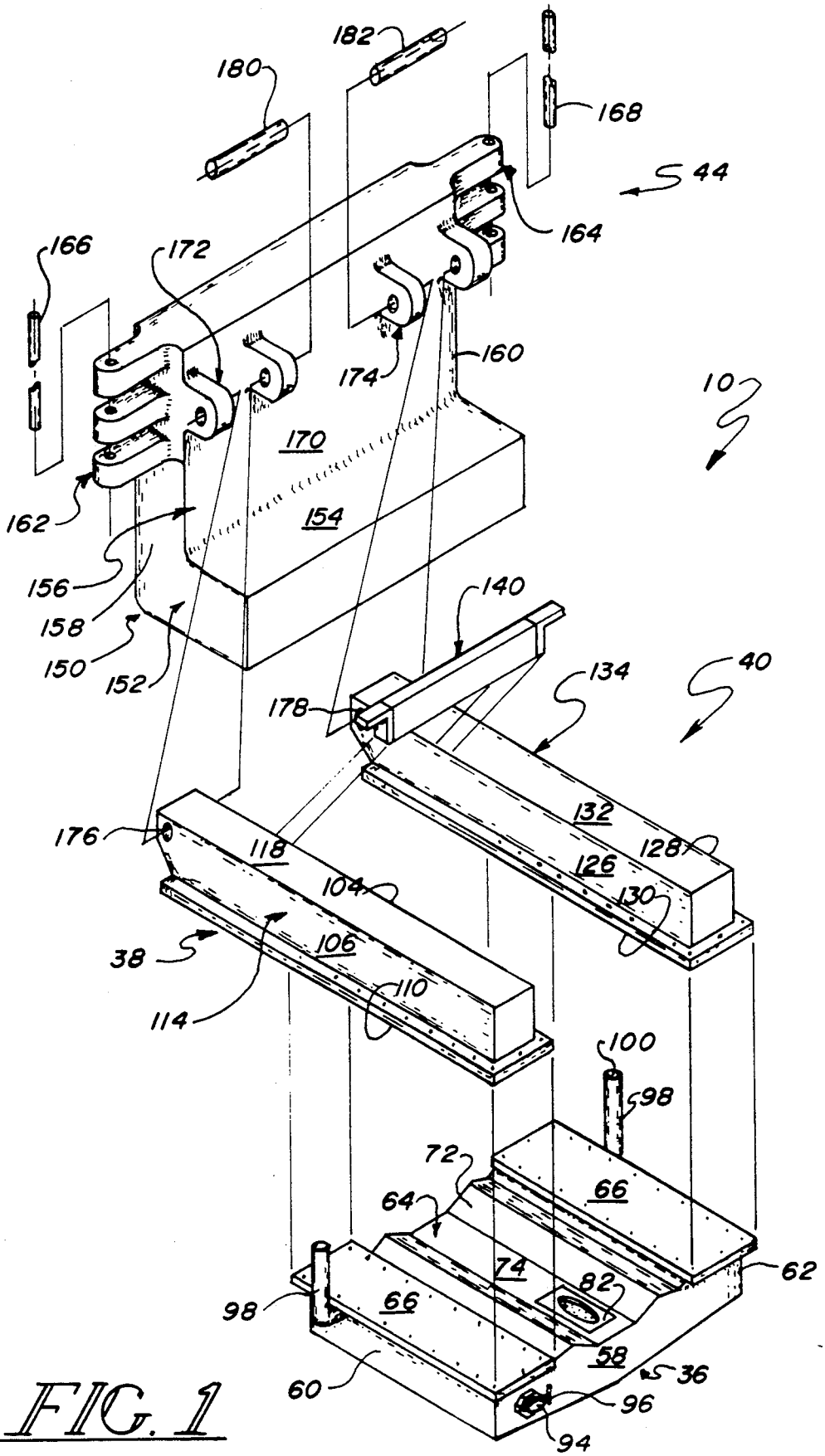
FIG. 1 is an exploded, perspective view of the lift of the present invention.
Figure 2:
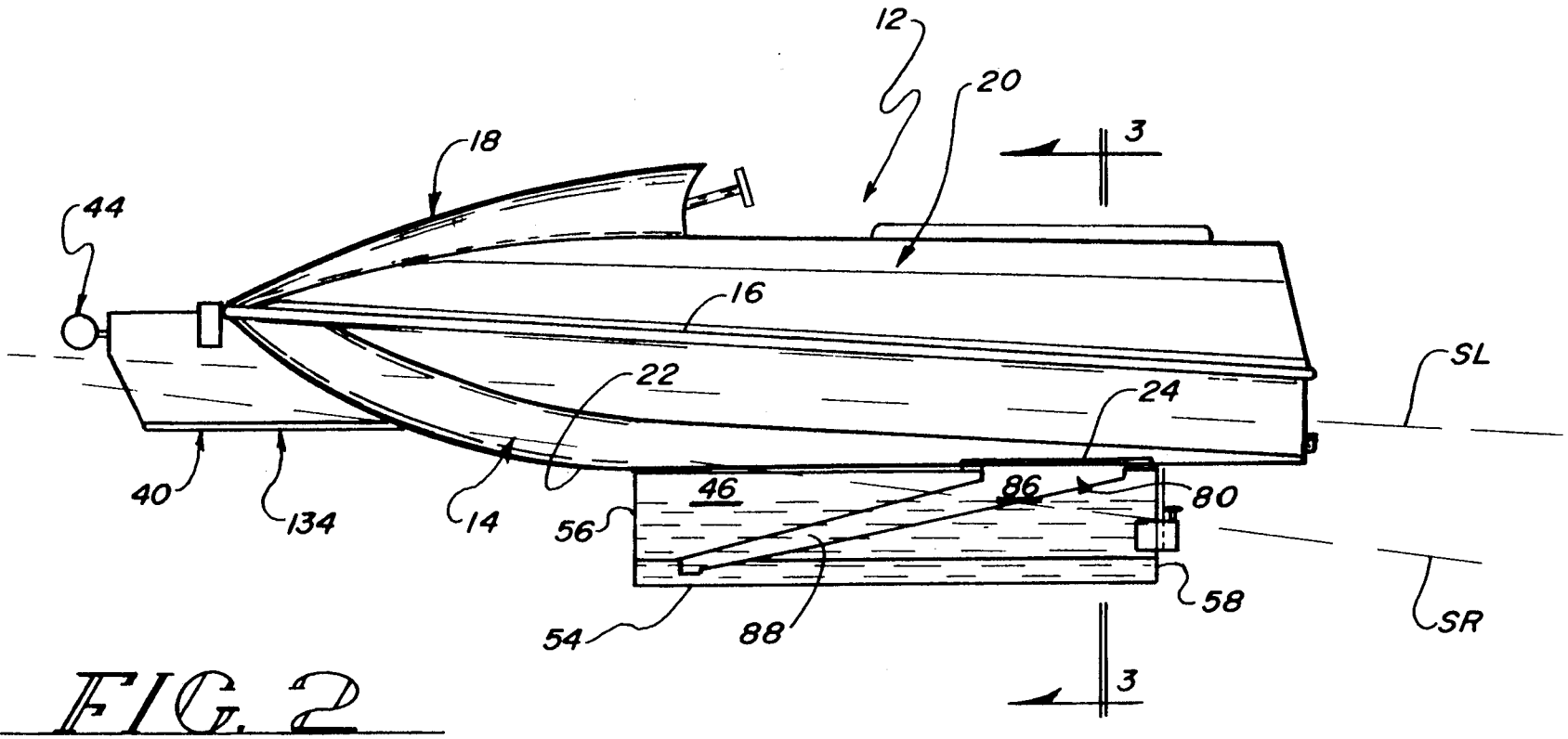
FIG. 2 is a side elevational view of a PWC on the lift of the present invention.
Figure 3:
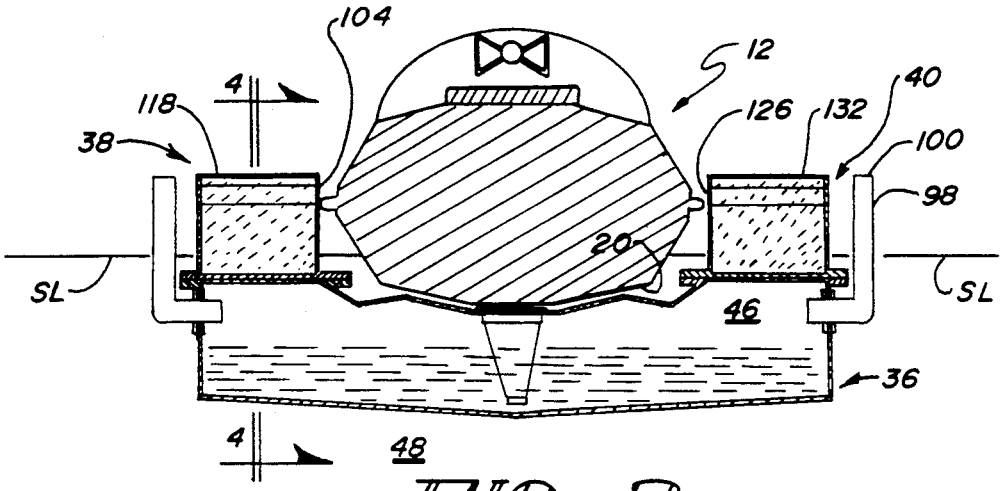
FIG. 3 is a sectional view taken along lines 3—3 of FIG. 2, showing a PWC on the lift.
Figure 4:
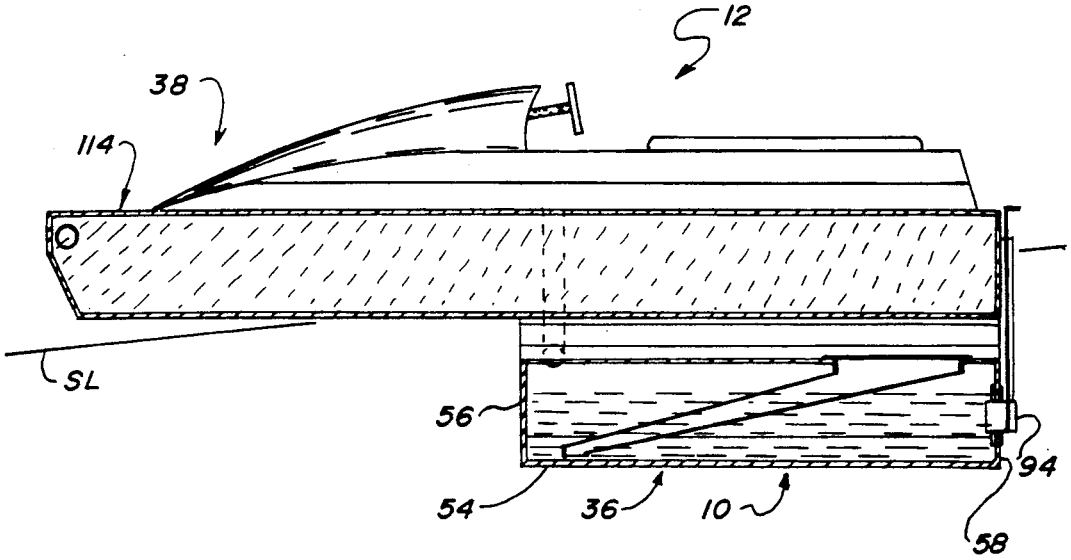
FIG. 4 is a sectional view taken along lines 4—4 of FIG. 3.
Figure 5:
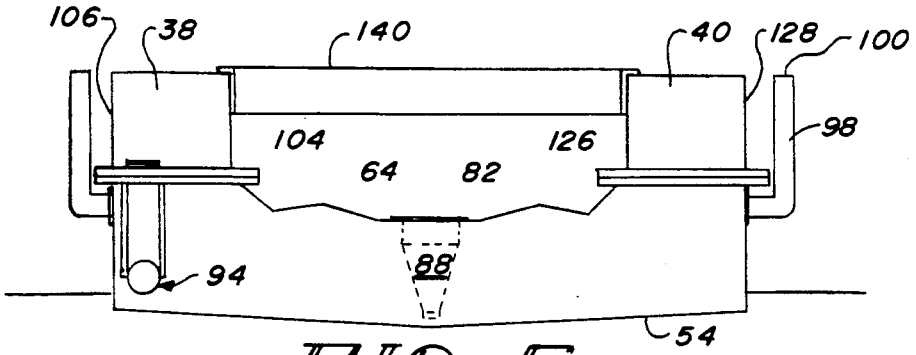
FIG. 5 is a rear elevational view of the lift of the present invention.
Figure 6:
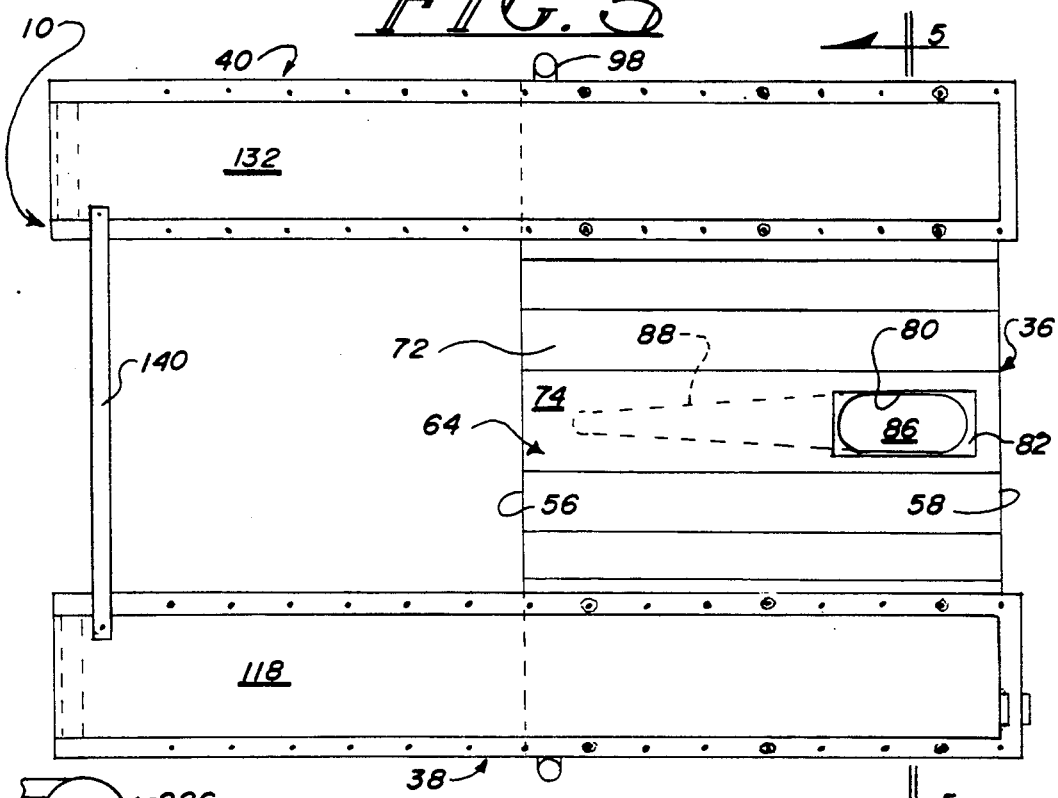
FIG. 6 is a top view of the lift of the present invention.

A lift 10 which is placeable in a waterbody, such as a lake, river, stream or ocean, and is usable in connection with a watercraft, such as a personal watercraft (PWC) 12 is shown in FIGS. 1-6. The waterbody includes a surface. For clarity of discussion, the surface of the water body will be designated as SR when the lift 10 is raised, and SL when the lift 10 is in its lowered position. Turning now specifically to FIG. 2, a PWC 12 is shown in more detail. The PWC 12 is illustrated to be a multiperson PWC similar to a YAMAHA WAVERUNNER brand personal watercraft, or a KAWASAKI TANDEM JETSKI brand personal watercraft.

The PWC 12 includes a hull 14 which, for purposes of this discussion is considered to be that portion of the personal watercraft 12 below rub rail 16. The PWC 12 also includes a hood section 18 that covers the engine (not shown) compartment and a passenger section 20. The passenger section 20 contains suitable controls, such as an on/off switch, fuel gauge and a steering wheel, and a plurality of seats upon which a user can sit while operating the PWC 12. The underside surface 22 of the hull 14 includes a generally rectangular grate 24 which serves as a porous covering for the water intake port (not shown) of the PWC 12.

As is discussed above, the water intake port leads to a water tunnel (not shown) that contains an impeller (not shown) driven by a mechanical linkage (not shown) which is itself driven by the engine (not shown) of the PWC 12. The impeller is contained within the water tunnel to prevent the moving parts of the impeller and drive mechanism from causing injury by entangling body parts or clothing of the user. Propulsion of the PWC 12 is accomplished by the impeller drawing water in through the grate 24 and water intake port, and then propelling the water out of a water exhaust port (not shown) disposed adjacent the rear end of the PWC 12. The PWC 12 propulsion system propels the PWC 12 by forcing a jet of water out the rear end of the PWC.

The lift 10 includes a tank 36, an elongated, longitudinally extending first floatation means 38 attached to the tank 36, and an elongated, longitudinally extending second floatation means 40 which is also mounted to the tank 36. An anchoring means 44 is provided for securely anchoring the lift 10 to a fixed object, such as the bed of the waterbody, a sea wall, a permanently affixed pier, or an on-shore object such as a tree. The lift 10 is preferably comprised of a plastic material, and is fabricated through a spin-casting type molding process.

The tank 36 includes an interior 46 and an exterior 48. The interior 46 of the tank includes a hollow chamber. In the lift 10 shown in the drawings, the hollow chamber comprises the entire interior 46 of the tank 36. Alternately, the chamber can comprise only a portion of the interior 46 of the tank. Considerations governing the size, shape, and position of the chamber will be discussed below in connection with the discussion of the buoyancy characteristics of the lift 10.

The tank 36 is generally mattress-shaped, and includes a generally outwardly bowed, hemi-cylindrical bottom surface 54, which helps to increase the stability of the lift 10 in the waterbody. The tank 36 also includes a generally vertically extending front surface 56, rear surface 58, first side surface 60 and second side surface 62. The front surface 56 and rear surface 58 extend transversely between the generally longitudinally extending first and second side surfaces 60 and 62. The tank 36 also includes an upper surface 64. The upper surface 64 includes generally planar, longitudinally extending, horizontally disposed edged portions 66 adjacent to each of the first and second side surfaces 60, 62 and a central portion 72 disposed between the edged portions 66. The central portion 72 is generally concavely shaped to receive the underside surface 22 of the hull 14 of the PWC 12 in a stable relation.

The upper surface 64 of a tank 36 also includes a generally horizontally disposed, planar, longitudinally extending center strip 74. Center strip 74 extends longitudinally along the center of the central portion 72 of the upper surface 64.

A water outflow port 80 which is in fluid communication with the chamber in the interior 46 of tank 36 has an opening 82 disposed on the center strip 74 of the upper surface 64 of the tank 36. The opening 82 of the water outflow port 80 is generally either a rectangular opening, or an elongated hexagonal opening. The opening 82 is sized and shaped to be matable with the grate 24 of the water intake port 26 of the PWC. A soft plastic, rubber, or gasket material lines the edges of the opening 82 to provide a better seal between the opening 82 and the grate 24. Additionally, the lining material helps to prevent the edges of the opening 82 from damaging the hull 14 of the PWC 12, or the hull 14 of the PWC 12 from damaging the edges of the opening 82.

A well 86 is disposed below the opening 82. The well 82 is provided for retaining generally between a one-half and one gallon of water. The well 86 retains water to provide a "prime" of water for the water intake port 26 of the PWC 12. A tube member 88 extends into the chamber from the lowest portion of the well 86. Preferably, the tube member 88 extends into the lower portion of the chamber, so that when water is drawn from the water outflow port 80, the water is drawn from the lowest portion of the chamber.

A water inflow port 94 having selectively actuable valve 96 is disposed on the rear surface 58 of the tank 36. The water inflow port 94 is in fluid communication with the chamber. The selectively actuable valve 96 preferably includes a handle for permitting the user to open and close the valve 96. Preferably, the water inflow port 94 is disposed on the lower portion of the rear surface 58 in a position where, when the water is drawn out of the chamber and the PWC 12 is resting upon the upper surface 64 of the tank 36, the water inflow port 94 will be disposed at or below the surface SR of the waterbody. In this regard, the reader's attention is directed to FIG. 2.

A vent pipe 98 is disposed on each of the first and second side surfaces 60, 62 of the tank 36. Each vent pipe 98 includes a first terminus (not shown) in fluid communication with the chamber, and a second terminus 100. The second terminus 100 is positioned at a sufficiently elevated level to generally be above the surface SL (FIG. 2) of the waterbody when the chamber is filled with water. The second terminus 100 of the vent pipe 98 should be as elevated as possible above the surface of the body of water to prevent large waves from causing water to flow into the second terminus 100 of the vent pipe 98, and consequently into the chamber.

The first floatation means 38 comprises a longitudinally extending, elongated rectangular tube. Preferably, the first floatation means 38 is designed to either be water-tight, or to contain floatation material within its interior to give buoyancy to the first floatation means 38. Alternately, the first floatation means 38 could be formed from a buoyant material. The first floatation means 38 includes a first or inner side surface 104, a second or outer side surface 106 and an underside surface 110. The first and second side surfaces 104, 106 are generally disposed in vertical plane, and the underside surface 110 is generally disposed in a horizontal plane.

The underside surface 110 is placed in an opposed relation to mate with one of the edge portions 66 of the upper surface 64 of the tank 36. The underside surface 110 is placed in contact with the edge portion 66 of the upper surface 64 to position the outer side surface 106 adjacent to, and generally co-planar with the first side surface 60 of the tank 36. Through this positioning, the first floatation means 38 extends generally along the entire first side 60 of the upper surface 64 of the tank 36.

The first floatation means 38 also includes a forward portion 114 that extends forwardly of the front surface 56 of the tank 36 along a distance of approximately four feet (1.22 meters). The upper surface 118 of the first floatation means 38 is generally planar to serve as a walkway for aiding the user in mounting and dismounting the PWC 12 when the PWC 12 is resting on the upper surface 64 of the tank 36. The upper surface 118 preferably has a textured surface to reduce the likelihood that a user will slip when walking on the upper surface 118. Alternately, one or more "grip strips" (not shown) having roughened upper surfaces can be adhesively attached to the upper surface 118 of the first floatation means 38.

The forward portion 114 of the first floatation means 38 extends forwardly of the front surface 56 of the tank 36 for a variety of reasons. One purpose served by this forward portion 114 is that it provides additional floatation and buoyancy to the tank 36. A second reason for this forward portion 114 is that its upper surface 118 provides an extended walkway for the user. As will be appreciated, the draft requirements of many watercraft and the draft of the lift 10 itself will likely require a sufficient depth of water to enable the PWC 12 to be launched from lift 10 properly. As the depth of a waterbody generally increases as one moves further away from the shore, this extended walkway helps to position the rear surface 58 of the tank 36 in a position wherein it is more likely that the lift 10 and PWC 12 will have a sufficient depth of water in which to operate properly.

A third feature provided by the forward portion 114 of the first floatation means 38 is that it helps to provide for an angled descent of the lift 10 into the water as the chamber fills with water. That is, when the chamber is completely filled with water, the lift 10 will generally be at an inclined angle to the surface of the waterbody, such that the front surface 56 of the tank 36 is at a level higher than the rear surface 58 of the tank 36.

Second floatation means 40 is generally similar in size, shape, construction, and purpose to first floatation means 38. That is, second floatation means 40 comprises an elongated rectangular tube having a first or inner side surface 126 a second or outer side surface 128, and an underside surface 130 disposed adjacent to an edge portion 66 of the tank 36, and a generally planar upper surface 132 for serving as a walkway for the user. The second or outer side surface 128 is disposed adjacent to, and is generally co-planar with the second side surface 62 of the tank 36. The second floatation means 40 also includes a forward portion 134 which extends forwardly beyond the front surface 56 of the tank 36.

The respective first side surfaces 104, 126 of the first and second floatation means 38, 40 are disposed generally parallel to each other and serve as lateral positioning means for aiding in the lateral positioning of the PWC 12 on the upper surface 64 of the tank 36. This lateral positioning helps to align the grate 24 of the hull 14 of the PWC 12 with the opening 82 of the water outflow port 80 of the tank 36.

The respective first and second surfaces 104, 126 can achieve their lateral positioning in two manners. The first manner is that the first and second side surfaces 104, 126 can be spaced apart at a distance only slightly greater than the width of the beam of the PWC 12. With the first and second floatation means 38, 40 (and their respective inner side surfaces 104, 126) being separated by a distance only slightly wider than the beam of the PWC 12, the user is compelled to properly align the PWC 12 on the upper surface 64 of the tank 36 when driving the PWC 12 onto the upper surface 64 of the tank 36. Alternately, the first side surfaces 104, 126 can be spaced apart at a distance significantly greater than the width of the beam of the PWC 12. Although this placement would not force the PWC 12 to be properly laterally aligned on the upper surface 64 of the tank, the first side surfaces 104, 106 would still help to laterally position the PWC 12 on the upper surface 64 by providing a visual guide to the user when driving the PWC onto the upper surface 64.

A transverse member 140 extends between the first and second floatation means 38, 40, adjacent to the front surface 56 of the tank 36. The transverse member 140 is provided for longitudinally positioning the PWC 12 on the upper surface 64 of the tank 36. The transverse member 140 should have a sturdy construction. The transverse member 140 serves as a "stop" for the PWC 12, to stop the forward movement of the PWC 12 on the upper surface 64 when the PWC is being driven on to the surface 64. The longitudinal position of the transverse member 140 is adjustably positionable along the floatation means 38, 40 to accommodate PWCs having different lengths.

The anchoring means 44 shown in FIG. 2 is an anchoring means especially adapted for use with the lift 10 where a pier or sea wall is not available to which the lift 10 can be anchored. The anchoring means 44 is especially adaptable for use if the lift 10 is used along the bank of a river or lake, or near the shore of the sea or an arm thereof.

The anchoring means 44 comprises a transversely disposed floatation pod 150. The pod 150 is generally made to be buoyant and floatable, and can be constructed similarly to the first and second floatation means 38, 40. The pod 150 includes a base portion 152 having a horizontally disposed upper surface 154. The horizontally disposed upper surface 154 is provided for receiving the underside surfaces 110, 130 of the forward portions 114, 134 of the first and second floatation means 38, 40. That is, the underside surfaces 110, 130 can rest upon the horizontally disposed upper surface 154.

The floatation pod 150 also includes an upstanding backboard portion 156 having a first side surface 158 and a second side surface 160. A vertically disposed first side gudgeon 162 is disposed on the upper portion of the first side surface, and a vertically disposed second side gudgeon 164 is disposed on the upper portion of the second side surface 160. The first side gudgeon 162 includes a series of aligned apertures for slidably receiving a first post 166. The second side gudgeon 164 includes a series of aligned apertures for slidably receiving a second post 168. The lower portions of the first and second posts 166, 168 can be driven into the bed of the river, lake or other water body in which the anchor means 44 and lift 10 are used. The posts 166, 168 are provided for stationarily positioning the anchor means 44 and hence the lift 10. The gudgeons 162, 164 slidably receive the posts 166, 168 to permit the pod 150, (and hence lift 10) to move vertically on the posts 166, 168 to accommodated differences in the level of the surface of the water body.

The backboard portion 156 includes a vertically disposed rear surface 170. The rear surface 170 includes a horizontally disposed first rear gudgeon 172, and a horizontally disposed second rear gudgeon 174. The individual members of each of the first and second rear gudgeons 172, 174 are spaced apart to interiorly receive, and be alignable with horizontally disposed apertures 176, 178 that extend through the first and second floatation means 38, 40 respectively.

A first post-like pintle 180 is provided for extending through the first rear gudgeon 172 and aperture 176 in first floatation means 38 to pivotably attach the first floatation means 38 to the transverse floatation pod 150. A second post 182 extends through the second rear gudgeon 174 and the aperture 178 in the forward portion 134 of the second floatation means 40 to pivotably attach the second floatation means 40 to the floatation pod 150. As will be appreciated, by securing the first and second floatation means 38, 40 to the floatation pod 150, the entire lift 10 is secured to the transverse floatation pod 150. The pivotable attachment between the first and second floatation means 38, 40 and the floatation pod 150, permits the lift 10 to pivot about a vertical arc, the axis of which are posts 180, 182. Post 180, 182 are preferably disposed colinearly, so that first floatation means 38 pivots about an axis collinear to the axis about which second floatation means 40 pivots.

The purpose of the floatation pod 150 type anchoring means is to provide additional floatation and stability to the lift 10, in situations where such additional stability cannot be provided by a fixed pier or sea wall. The placement of the floatation pod 150 at the front of the lift 10, helps to maintain the first and second floatation means 38, 40 generally level during such time as when a user is walking on the upper surfaces 118, 132 of the first and second floatation means 38, 40.

In situations wherein a pier or sea wall is available, the floatation pod need not be used. Clips (not shown) can be extended through apertures 176, 178, and attached to the pier or sea wall to securely anchor the lift 10 to the pier or sea wall.

The purpose of the anchor means 44 is to securely attach the lift 10 to a fixed object, to prevent the lift 10 from floating away from the place in which it is anchored. The particular anchoring configuration best suited for use with the lift 10 will likely vary depending upon the nature of the body of water in which the lift 10 is placed. The primary requirement for any such anchoring, however, is that the anchoring means not prohibit the lift 10 from moving in a generally vertical arc during such time as water is being introduced into the chamber, and water is being removed from the chamber of the tank 46.

Figure 7:
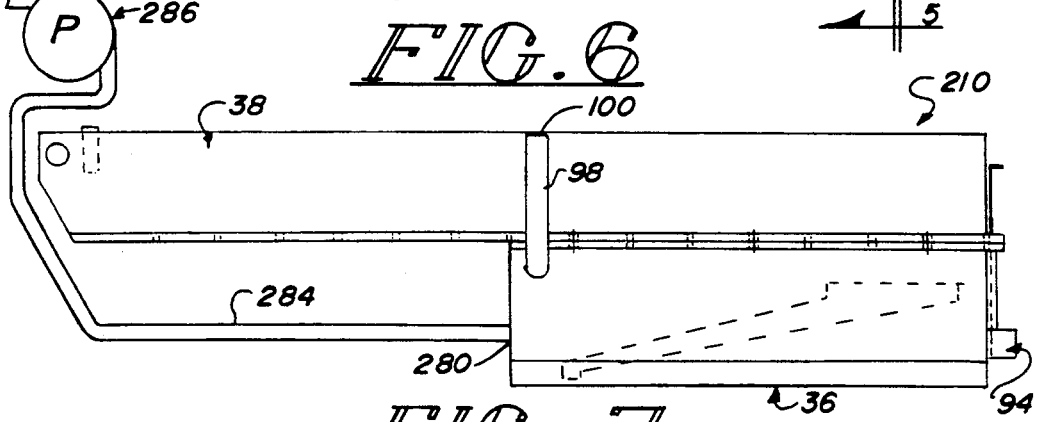
FIG. 7 is a side elevational view of an alternative embodiment of the lift of the present invention.

An alternate embodiment of the lift 210 is shown in FIG. 7. Lift 210 is generally similar to lift 10, except that it is designed for use with a watercraft not having the high pressure water intake means found in a PWC 12. Lift 210 is configured generally identically to lift 10 with the exception of the positioning of the water outflow port. It will be noticed that water outflow port 280 is positioned on the front surface 56 of the tank, and is coupled to a tube 284 that extends to an electric pump 286. The electric pump 286 serves as a water drawing means for drawing water from the interior of the chamber of the tank of lift 210. A suitable control (not shown) can be provided to enable the user to actuate the pump 286 to begin drawing water from the chamber. As will be appreciated, the electric pump 286 should be sufficiently well insulated and grounded so as to minimize the risk of electrical shock to the user.

Although the pump 286 is shown in FIG. 7 as being an electric pump spatially separated from the lift 210, it will also be appreciated that the pump 286 can be built integrally into the lower portion of the chamber of the tank, in much the same manner as a bilge pump on a large boat. Another means of supplying electric power to the pump 286 is through the use of the 12 Volt DC battery and electrical system of the PWC 12.

The lift 10 operates as follows:

The lift 10 is placed in the water with the front surfaces of the first and second floatation means being securely attached by the anchoring means 44 to a fixed object. As the PWC 12 is not resting on the upper surface 64 of the tank 36, the floatation configuration of the tank 36 and floatation means 38, 40 will likely place the lift 10 in a position where the rear surface 58 of the tank 36 is generally at a higher level than the front surface 56 of the tank 36. Of course, this assumes that the chamber in the interior 46 of the tank 36 contains no water. The selectively actuable valve 96 is then opened to allow water to flow from the water body, through the water inflow port 94 and into the chamber of the tank 36. Due to the buoyancy of the tank 46 and floatation means 38, 40, it may be necessary to have the user stand on the rear portion of the upper surface 118 of the first floatation means 38 to cause the water inflow port 34 to sink below the level of water of the water body.

When the selectively actuable valve 96 is opened, water from the water body will flow through the water inflow port 94 into the chamber in the interior 46 of tank 36. As water enters the chamber, the weight of the water will cause the tank 36 of the lift 10 to sink downwardly into the water. In this regard, the lift 10 operates similarly to a submarine whose ballast tanks have been opened to draw in water. As water is drawn into the chamber, the lift 10 begins to sink to a point wherein the rear surface 58 of the tank 36 is disposed generally below the surface SL of the body of water.

The floatation within the floatation means 38, 40 is generally sufficient to prevent the tank 46 from traveling too far below the surface of the body of water. For example, if the rear surface 58 is in water that is six feet deep, the filling of the chamber will not cause the bottom surface 54 of the tank 36 to contact the bed of the body of water. Rather, the floatation means 38, 40 will keep the portion of the upper surface 64 adjacent to the rear surface 58 in a position only a few inches (e.g. one to eight inches (2.54 to 20.32 cm)) below the surface SL of the water. Additionally, the forward portions 114, 134 of the floatation means 38, 40 generally ride high in the water so that when the chamber is filled with water, the lift 10 is at an inclined angle to the surface SL of the water such that the rear surface 58 is generally at a level below the front surface 56 of the tank 36. Thus, when the chamber is filled with water, the upper surface 64 of the tank 36 is positioned as an inclined ramp.

The user can then drive the PWC 12 onto the upper surface 64 of the tank 36. In doing so, the PWC 12 is positioned laterally on the upper surface 64 by the respective first side surfaces 104, 126 of the first and second floatation means 38, 40. The PWC 12 is driven onto the upper surface 64 so that the underside surface 22 of the hull 14 of the PWC 12 rests upon the central portion 72 of the upper surface 64 of the tank 36. The PWC 12 is driven forwardly on the central portion 72 until the portion of the rub rail 16 in the front of the PWC 12 engages the transverse member 140. This contact between the transverse member 140 and the rub rail 16 of the PWC 12 longitudinally positions the PWC 12 on the central portion 72 of the upper surface 64. The lateral positioning of the first side surfaces 104, 126 of the first and second floatation means 38, 40 and the longitudinal positioning of the transverse member 140 cooperate to position the PWC 12 on the upper surface 64 of the tank 36 so that the grate 24 of the PWC 12 mates with the opening 82 of the water outflow port 80.

During the mating of the grate 24 with the opening 82, the engine of the PWC, continues to run. The water that collects in the well 86 provides a "prime" of water which is drawn into the water intake port 26 of the PWC 12. The fluid communication between the well 86 and the chamber, through tube member 88, causes water to be drawn from the chamber. The water is pulled through the water intake port 26, exhausted out of the water exhaust port (not shown) of the PWC 12, and directed back into the body of water. During such time, the selectively actuable valve 96 should be closed to prevent the chamber from refilling with water.

As water empties from the chamber, the level of the lift 10 begins to rise. When the motor and impeller of the PWC 12 have drawn all of the water that they are capable of drawing out of the chamber, the lift 10 should be in its fully raised position. In its fully raised position, the lift 10 is generally level so that the front and rear surfaces 56, 58, of the tank 36 are at approximately the same level. At this fully raised level, the upper surface 64 of the tank 36 is generally above the level SR of the body of water. At this level, there should be insufficient water on the upper surface 64 to permit the hull 14 of the PWC 12 to float. This results in the full weight of the PWC 12 being applied to the upper surface 64 of the tank, to securely maintain the PWC 12 on the upper surface 64 of the tank. As an added measure, cleats (not shown) an be affixed to the upper surfaces 118, 132 of the first and second floatation means 38, 40. A line can be lashed to the cleat and the PWC 12 to secure the PWC 12 to the lift 10. When the lift 10 is in its fully raised position, the user shuts off the engine of the PWC 12 to halt any further intake of water into the water intake port 26 from the chamber of the tank 36.

To launch the PWC 12, the selectively actuable valve 96 is opened to allow water to flow through water inflow port 92 into the chamber. Water is allowed to flow into the water inflow port 92 until the rear surface 58 of the tank 26 is below the surface SL of the body of water. The rearwardly, downwardly incline of the lift 10 allows the PWC 12 to slide backwardly off the lift 10 and into the water, to permit the PWC 12 to be used on the body of the water.

As will be appreciated, certain buoyancy relationships exist between the various components, such as the tank 36 and floatation means 38, 50 that should be satisfied in order to enable the lift 10 to permform properly. These buoyancy relationships affect the size and manner of construction of the lift 10.

The buoyancy relationships discussed below are provided by way of example, and not intended to be limiting. The assumptions made for the buoyancy calculations below are based upon personal watercraft such as the one illustrated that has a weight of approximately 451 pounds. Additionally, it is assumed that the lift 10 has a weight of about 150 pounds. As will be appreciated, the use of a lighter or heavier lift, or the use of a lighter or heavier PWC would alter the calculations given in the example below.

It follows naturally, that when the chamber is empty, and the PWC is on the lift 10, the lift 10 must provide sufficient buoyancy to support the 601 pounds of weight of the lift 10 and the PWC 12. In the configuration of the lift 10 shown in the drawings, it will be appreciated that a large portion of this buoyancy is provided by the tank 10, as the majority of the mass of the floatation means 38, 40 are disposed out of the water and rest on top of the tank 36. However, some buoyancy is provided by the forward portions 114, 134 of the floatation means 38, 40.

Generally, the buoyancy of the lift 10 water is largely a function of the displacement of the lift 10. That is, the greater the volume of water that the lift 10 displaces, the greater its buoyancy.

Assuming that the lift 10 is placed in fresh water, it will be appreciated that the lift 10 must displace approximately 9.8 cubic feet of water to support 601 pounds. As salt water has a lower specific gravity than fresh water, a smaller displacement would likely suffice for salt water applications.

When the chamber is filled during the launch of the PWC 12, different buoyancy relationships occur. The first change in relationship is that the buoyancy of the lift 10 must be decreased substantially (as compared to when the chamber is empty) to allow the tank 36 to sink into the water to a level wherein a portion of the upper surface 64 adjacent to the rear surface 58 of the tank 36 is slightly below the level of the water. This loss of buoyancy occurs through the intake of water into the chamber. Generally, the chamber must hold enough water to have sufficiently little remaining buoyancy so that most of the tank 36 is under the water. In a prototype model constructed by the applicants, the chamber of the dock 10 was configured to have a 60 gallon (8.02 cubic feet) capacity.

However, the floatation means 38, 40 must provide sufficient buoyancy to maintain the tank 36 at a predetermined level, slightly under the surface SL of the water, and to prevent the tank 36, where possible, from sinking to the bottom of the body of water. If the tank 36 sinks too low below the surface SL of the water, the gap between the opening 82 of the water outflow port 80 and the grate 24 of the water intake port 26 of the PWC 12 will be too large to enable the grate 24 and opening 82 to mate properly when the user desires to drive the PWC 12 back on to the lift 10, and raise the lift 10.

The buoyancy to maintain the tank 36 at this proper level is provided by the first and second floatation means 38, 40. Additionally, the buoyancy of the lift 10 is aided by the two vent pipes 98 that help to trap air in the chamber of the tank 36. The position of the first terminus of each of the vent pipes 98 is adjustable within the chamber. By adjusting the position of the first termini upwardly or downwardly, the user can adjust the amount of air that will be trapped in the chamber. Thus, the buoyancy of the lift 10 can be adjusted to accommodate PWCs 12 having different weights.

Additionally, the positioning of the buoyancy of the first and second floatation means 38, 40 is also important. By extending forwardly beyond the front surface 56 of the tank 36 the forward portions 119, 134 of the first and second floatation means 38, 40, cause the tank 36 to be at an inclined level relative to the surface SL of the water when the chamber is full. When the tank 36 is so inclined, the front surface 56 of the tank 36 is at a higher level than the rear surface 58 of the tank. When the chamber is empty, and the PWC 12 is resting on the upper surface 64 of the tank 36, the forward portions 114, 134 of the first and second floatation means 38, 40, help to maintain the front surface 56 and rear surface 58 of the tank 36 at approximately the same level, so that the PWC 12 and lift 10 are generally level in the water.

Although the invention has been described in detail with reference to the illustrated preferred embodiments, variations and modifications exist within the scope and spirit of the invention as described and as defined in the following claims:

What is claimed is:

1. A lift placeable in a water body for a watercraft having a water intake port and water drawing means for drawing water through the water intake port, the lift comprising:

a tank having (1) an interior and an exterior, the interior including a generally hollow chamber, (2) an upper surface configured for receiving the watercraft, (3) a water inflow port and a selectively actuable valve means for permitting water to flow into the chamber, and (4) a water outflow port configured to be matable with the water intake port, wherein the water intake port of the watercraft can be mated with the water outflow port of the tank to permit the water drawing means of the watercraft to draw water out of the chamber of the tank.

2. The invention of claim 1 wherein the upper surface of the tank is configured for receiving an underside surface of a hull of the watercraft, and the water outflow port includes a generally planar opening which is disposed on the upper surface for mating with the water intake port of the watercraft which is disposed on the underside surface of the hull of the watercraft.

3. The invention of claim 2 wherein the chamber of the tank is sized so that when water is drawn from the chamber by the water drawing means, and said lift has sufficient buoyancy to maintain the underside surface of the hull of the watercraft generally above the surface of the water body.

4. The invention of claim 2 wherein the water outflow port includes a well in fluid communication with the chamber for retaining a quantity of water to provide a prime for facilitating the drawing of water from the chamber.

5. The invention of claim 1 further comprising a floatation means coupled to the tank, the floatation means including a portion extending forwardly of the chamber.

6. The invention of claim 5 wherein the tank includes a front surface, a rear surface, a first-side surface and a second-side surface, and the floatation means possess sufficient buoyancy to maintain a portion of the upper surface of the tank adjacent the rear surface at a level slightly below the surface of the water body when the chamber is filled with water.

7. The invention of claim 6 wherein the portions of the floatation means that extend forwardly of the chamber possess sufficient buoyancy to maintain the front surface of the tank at a level above the level of the rear surface of the tank when the chamber is filled with water.

8. The invention of claim 7 wherein the floatation means are configured to maintain the front surface of the tank generally level with the rear surface of the tank when the watercraft is resting on the upper surface of the tank, and the water drawing means has withdrawn the water from the chamber.

9. The invention of claim 1 further comprising first and second floatation means coupled to the tank for providing buoyancy to the tank.

10. The invention of claim 9 wherein each of the first and second floatation means extends longitudinally along the tank and includes a side surface, the side surface of the first floatation means and the side surface of the second floatation means being positioned to provide a lateral positioning means for the watercraft resting on the upper surface of the tank.

11. The invention of claim 9 wherein the tank includes a front surface and a rear surface, and each of the first and second floatation means includes a forward portion that extends forwardly of the front surface of the tank, and the forward portions of the first and second floatation means possess sufficient buoyancy to maintain the front surface of the tank at a level above the level of the rear surface of the tank when the chamber is filled with water.

12. The invention of claim 9 wherein the tank includes a first side surface and a second side surface, and each of the first and second floatation means includes an underside surface, the underside surface of the first floatation means being mounted to the upper surface of the tank means adjacent the first side surface of the tank, and the underside surface of the second floatation means being mounted to the upper surface of the tank adjacent the second side surface.

13. The invention of claim 12 further comprising a transverse member extending between the first and second floatation means for providing longitudinal positioning for the watercraft when resting on the upper surface of the tank.

14. The invention of claim 9 further comprising at least one vent pipe having a first terminus in fluid communication with the chamber of the tank, and a second terminus positioned to be above the surface of the water body when the chamber is filled with water.

15. The invention of claim 9 wherein at least one of the first and second floatation means is disposed adjacent to a side of the tank, extends generally along the length of the tank, and includes a generally planar upper surface for serving as a walk way for a user of the watercraft to facilitate mounting and dismounting of the watercraft by the user.

16. A lift placeable in a water body for a watercraft, the lift comprising, (1) a generally mattress shaped tank having an interior and an exterior, the interior including a generally hollow chamber, an upper surface configured for receiving the watercraft, a front surface, a rear surface, a first side surface and a second side surface, a water inflow port and a selectively actuable valve for permitting water to flow into the chamber, and a water outflow port for permitting the water to be withdrawn from the chamber, (2) a water withdrawing means matable to the water outflow port for withdrawing water from the chamber, and (3) an anchoring means comprising (a) a floatation pod including at least one vertically extending gudgeon means and at least one horizontally extending gudgeon means, (b) a first post means engageable with the at least one vertically extending gudgeon means and attachable to a secure object for securing the floatation pod to the secure object, and (c) a second post means engageable with the at least horizontally extending gudgeon means.

17. The invention of claim 16 wherein the water withdrawing means comprises a pump.

18. The invention of claim 16 further comprising a first longitudinally extending floatation means disposed adjacent the first side surface, and a second longitudinally extending floatation means disposed adjacent the second side surface, at least one of the first and second floatation means including a generally planar upper surface for serving as a walk way for a user of the watercraft to facilitate mounting and dismounting of the watercraft by the user.

19. The invention of claim 16 further comprising a first longitudinally extending floatation means disposed adjacent the first side surface, and a second longitudinally extending floatation means disposed adjacent the second side surface, the first and second floatation means possessing sufficient buoyancy to maintain the portion of the upper surface of the tank adjacent the rear surface of the tank at a level slightly below the surface of the water body when the chamber is filled with water.

20. A lift placeable in a water body for a watercraft, the lift comprising, (1) a generally mattress shaped tank having an interior and an exterior, the interior including a generally hollow chamber, an upper surface configured for receiving the watercraft, a front surface, a rear surface, a first side surface and a second side surface, a water inflow port and a selectively actuable valve for permitting water to flow into the chamber, and a water outflow port for permitting the water to be withdrawn from the chamber, (2) a first longitudinally extending floatation means disposed adjacent the first side surface, and (3) a second longitudinally extending floatation means disposed adjacent the second side surface, the water outflow port being matable to a water intake port of a watercraft for withdrawing water from the chamber.

21. A lift placeable in a water body for a watercraft, the lift comprising, (1) a generally mattress shaped tank having an interior and an exterior, the interior including a generally hollow chamber, an upper surface configured for receiving the watercraft, a front surface, a rear surface, a first side surface and a second side surface, a water inflow port and a selectively actuable valve for permitting water to flow into the chamber, and a water outflow port for permitting the water to be withdrawn from the chamber, (2) a first longitudinally extending floatation means disposed adjacent the first side surface, (3) a second longitudinally extending floatation means disposed adjacent the second side surface, (4) a water withdrawing means matable to the water outflow port for withdrawing water from the chamber, and (5) an anchoring means comprising (a) a floatation pod including at least one vertically extending gudgeon means and at least one horizontally extending gudgeon means, (b) a first post means engageable with the vertically extending gudgeon means and attachable to a secure object for securing the floatation pod to the secure object, and (c) a second post means engageable with the horizontally extending gudgeon means and at least one of the first and second floatation means for pivotably coupling the flit to the floatation pod.

22. A lift placeable in a water body for a watercraft, the lift comprising, (1) a generally mattress-shaped tank having an interior and an exterior, the interior including a generally hollow chamber, a generally concave upper surface configured for receiving an underside surface of a hull of the watercraft, a front surface, a rear surface, a first side surface and a second side surface, a water inlet port and a selectively actuable valve means for permitting water to flow into the chamber, the water inlet port disposed on the rear surface of the tank, a water outflow port disposed on the upper surface of the tank through which water can be drawn out of the chamber, the water outflow port having a generally planar opening conforming generally to a portion of the upper surface of the tank, and a well for retaining a quantity of water, the water in the well being in fluid communication with water in the chamber, (2) a longitudinally extending first floatation means disposed on the upper surface of the tank adjacent to the first side surface of the tank, the first floatation means including a forward portion disposed forwardly of the front surface of the tank, and a generally planar upper surface for serving as a walking surface for the user, (3) a longitudinally extending second floatation means disposed on the upper surface of the tank adjacent the second side surface of the tank, the second floatation means including a forward portion disposed forwardly of the front surface of the tank, and (4) transverse member extending between the first and second floatation means, wherein:

(a) when water has been withdrawn from the chamber and the watercraft is resting on the upper surface of the tank, the tank and first and second floatation means possess sufficient buoyancy to maintain the front surface generally level with the rear surface of the tank, and the underside surface of the hull of the watercraft generally above the surface of the waterbody;

(b) when the chamber is filled with water, the tank and first and second floatation means possess sufficient buoyancy to maintain the portion of the upper surface of the tank adjacent to the rear surface of the tank at a level slightly below the surface of the water body, and the portion of the upper surface of the tank adjacent to the front surface at a level above the level of the portion of the upper surface adjacent the rear surface;

(c) the first and second floatation means are sized and positioned to provide a lateral positioning means for the watercraft resting on the upper surface;

(d) the transverse member is sized and positioned to provide a longitudinal positioning means for the watercraft resting on the upper surface; and (e) the opening of the water outflow port is sized and positioned to be matable with a water intake means of the watercraft so that a placement of the watercraft on the upper surface of the tank, and the operation of a water drawing means of the watercraft causes water to be drawn from the chamber, through the water outflow port and into the water intake means of the watercraft.

* * * * *